US009281641B2

(12) United States Patent
Baechle et al.

(10) Patent No.: US 9,281,641 B2
(45) Date of Patent: Mar. 8, 2016

(54) CONNECTING DEVICE FOR ELECTRICALLY CONNECTING TWO CIRCUIT BOARDS

(71) Applicant: Telegaertner Karl Gaertner GmbH, Steinenbronn (DE)

(72) Inventors: Erik Baechle, Filderstadt (DE); Reinhard Vogl, Steinenbronn (DE); Gerd Kruegel, Neuhausen (DE)

(73) Assignee: Telegaertner Karl Gaertner GmbH, Steinenbronn (DE)

( * ) Notice: Subject to any disclaimer, the term of this patent is extended or adjusted under 35 U.S.C. 154(b) by 0 days.

(21) Appl. No.: 14/516,748

(22) Filed: Oct. 17, 2014

(65) Prior Publication Data

US 2015/0118904 A1 Apr. 30, 2015

(30) Foreign Application Priority Data

Oct. 29, 2013 (DE) ..... 10 2013 111 905

(51) Int. Cl.

| | |
|---|---|
| ***H01R 12/00*** | (2006.01) |
| ***H01R 24/50*** | (2011.01) |
| ***H01R 12/71*** | (2011.01) |
| ***H01R 12/91*** | (2011.01) |

(Continued)

(52) U.S. Cl.

CPC ..... *H01R 24/50* (2013.01); *H01R 12/716* (2013.01); *H01R 12/91* (2013.01); *H01R 13/5219* (2013.01); *H01R 24/542* (2013.01)

(58) Field of Classification Search

CPC ..... H01R 24/50; H01R 12/716; H01R 12/91; H01R 24/542; H01R 13/5219

USPC ..... 439/578, 248, 247, 63, 74, 591

See application file for complete search history.

(56) References Cited

U.S. PATENT DOCUMENTS

| | | | |
|---|---|---|---|
| 2,707,273 | A | 4/1955 | Klassen |
| 4,873,532 | A | 10/1989 | Sakurai et al. |

(Continued)

FOREIGN PATENT DOCUMENTS

| | | |
|---|---|---|
| DE | 38 34 074 | 1/1997 |
| DE | 196 07 706 | 9/1997 |

(Continued)

OTHER PUBLICATIONS

European Search Report for corresponding application EP 14 18 9772 dated Feb. 27, 2015, 6 pages.

*Primary Examiner* — Abdullah Riyami
*Assistant Examiner* — Nelson R Burgos-Guntin
(74) *Attorney, Agent, or Firm* — Lipsitz & McAllister, LLC

(57) ABSTRACT

A connecting device for electrically connecting two circuit boards is provided. The connecting device has a first and a second coaxial connector and a coupling member. The two coaxial connectors and the coupling member each have an outer conductor and an inner conductor. The outer conductors of the coaxial connectors are electrically interconnected via the outer conductor of the coupling member and the inner conductors of the coaxial connectors are electrically interconnected via the inner conductor of the coupling member. The coupling member is arranged between the two coaxial connectors so as to be tiltable from an axially aligned orientation and displaceable in an axial direction. The coupling member is held on an elastically deformable dielectric holding ring which surrounds the coupling member in a circumferential direction and is in contact against at least one coaxial connector.

14 Claims, 4 Drawing Sheets

(51) Int. Cl.
*H01R 13/52* (2006.01)
*H01R 24/54* (2011.01)

(56) References Cited

U.S. PATENT DOCUMENTS

| | | | | |
|---|---|---|---|---|
| 4,925,403 | A | 5/1990 | Zorzy | |
| 5,217,391 | A * | 6/1993 | Fisher, Jr. | H01R 24/44 439/578 |
| 5,672,079 | A * | 9/1997 | Leppert | G02B 6/3817 385/89 |
| 5,746,619 | A * | 5/1998 | Harting | H01R 24/40 439/352 |
| 5,853,295 | A | 12/1998 | Rosenberger | |
| 5,980,290 | A | 11/1999 | Meynier et al. | |
| 6,019,640 | A | 2/2000 | Härri | |
| 6,497,579 | B1 * | 12/2002 | Garbini | H01R 13/6315 439/246 |
| 9,022,799 | B2 * | 5/2015 | Sorolla Rosario | H01R 13/005 439/485 |
| 2002/0153976 | A1 | 10/2002 | Pluymers | |
| 2007/0004276 | A1 | 1/2007 | Stein | |
| 2007/0026698 | A1 | 2/2007 | Rosenberger | |
| 2011/0256760 | A1 | 10/2011 | Igarashi et al. | |
| 2012/0142232 | A1 | 6/2012 | Yin et al. | |
| 2014/0127940 | A1 * | 5/2014 | Wagner | H01R 13/6315 439/578 |
| 2015/0024628 | A1 * | 1/2015 | Haegele | H01R 9/05 439/585 |
| 2015/0118898 | A1 * | 4/2015 | Paynter | H01R 9/0503 333/24 C |
| 2015/0118899 | A1 * | 4/2015 | Hugel | H01R 24/542 439/578 |
| 2015/0118904 | A1 * | 4/2015 | Baechle | H01R 12/716 439/591 |

FOREIGN PATENT DOCUMENTS

| | | |
|---|---|---|
| DE | 197 44 030 | 6/1998 |
| DE | 298 01 115 | 6/1998 |
| DE | 195 40 614 | 5/1999 |
| DE | 202 08 425 | 9/2002 |
| DE | 100 57 143 | 2/2003 |
| DE | 20 2004 005 273 | 7/2004 |
| EP | 0793299 | 9/1997 |
| EP | 0 854 547 | 7/1998 |
| EP | 1 318 573 | 3/2005 |
| WO | WO 00/52788 | 9/2000 |
| WO | 2011015992 | 2/2011 |
| WO | 2013150059 | 10/2013 |

* cited by examiner

CONNECTING DEVICE FOR ELECTRICALLY CONNECTING TWO CIRCUIT BOARDS

This application claims the benefit of German patent application number 10 2013 111 905.0 filed on Oct. 29, 2013, which is incorporated herein by reference in its entirety and for all purposes.

BACKGROUND OF THE INVENTION

The invention relates to a connecting device for electrically connecting two circuit boards, the connecting device comprising a first and a second coaxial connector and a coupling member, wherein the two coaxial connectors and the coupling member each have an outer conductor and an inner conductor and the outer conductors of the coaxial connectors are electrically interconnected via the outer conductor of the coupling member and the inner conductors of the coaxial connectors are electrically interconnected via the inner conductor of the coupling member and wherein the coupling member is arranged between the two coaxial connectors so as to be tiltable from an axially aligned orientation and displaceable in an axial direction.

Electrical installations often use multiple circuit boards with conductive traces that must be electrically interconnected. In this regard, the circuit boards may have coaxial connectors arranged thereon, these then being connected to one another via, for example, a coaxial cable. The connection via coaxial cable is advantageous in that positional inaccuracies and relative movements of the two circuit boards can be compensated for. However, the connection using a coaxial cable is comparatively expensive and has the additional drawback that the spacings between the two circuit boards must be chosen to be relatively large.

Instead of having the coaxial connectors of the circuit boards interconnected via coaxial cable, it has been proposed that the two coaxial connectors be interconnected via a rigid coupling member. The coupling member is of substantially cylindrical configuration and makes it possible for the two circuit boards and the coaxial connectors fixed thereon to be arranged at a small spacing from one another. The coupling member has an inner conductor via which the inner conductors of the two coaxial connectors are interconnected. Furthermore, the coupling member has an outer conductor via which the outer conductors of the two coaxial connectors are interconnected. The coupling member is arranged between the two coaxial connectors and it can be tilted away from an orientation in which the coupling member is in axial alignment with the two coaxial connectors and it can be displaced in an axial direction. This makes it possible for the two circuit boards to be arranged at a small spacing from each other and to move relative to each other to a certain extent, while maintaining electrical connection therebetween. Furthermore, the tiltable and axially displaceable arrangement of the coupling member allows for positional inaccuracies to be compensated for.

A connecting device of the kind mentioned at the outset is known from German utility model number DE 202 08 425 U1. In the connecting device described therein, the coaxial connectors each have an inner conductor in the form of a contact pin which is capable of being brought into engagement with an end-face recess of the inner conductor of the coupling part. The outer conductors of the coaxial connectors each form an outer-conductor socket which can have the outer conductor of the coupling member plugged thereinto. The outer conductor of the coupling member has, at each of its ends, a surrounding annular bead which contacts the inner face of the outer-conductor socket. The known connecting device allows the coupling member to be axially displaced to a certain extent and to be tilted from an axially aligned orientation. However, there may be micromovements, in particular vibrations, of the coupling member occurring as a result of, for example, exposure to shock. The micromovements may cause abrasion, and this may impair the electric transmission properties of the connecting device.

The publication WO 00/52788 A1 proposes a connecting device in which the coupling member is mechanically connected to one of the two coaxial connectors by a fixed ball joint. While the fixed ball joint makes it possible for the coupling member to be tilted relative to the coaxial connector, it does not allow axial movement thereof with respect to said coaxial connector.

DE 100 57 143 C2 proposes a connecting device in which the coupling member is likewise mechanically connected to one of the two coaxial connectors. To this end, a radial extension arranged at the outside of the outer conductor of the coupling member latches into an annular groove arranged on the inside of the outer conductor, configured as an outer-conductor socket, of a coaxial connector. This constrains the freedom of movement of the coupling member. Furthermore, it has been shown that providing a latch connection may impair the electric transmission properties of the connecting device.

It is an object of the present invention to improve a connecting device of the generic kind such that it has improved electric transmission properties and the risk of micromovements of the coupling member can be reduced.

SUMMARY OF THE INVENTION

In accordance with the invention, this object is achieved in a connecting device of the kind mentioned at the outset by the coupling member being held on an elastically deformable dielectric holding ring which surrounds the coupling member in a circumferential direction and is in contact against at least one coaxial connector.

In the connecting device constructed in accordance with the invention, the coupling member supports itself via an elastically deformable dielectric holding ring against at least one coaxial connector, in particular against an outer conductor of at least one coaxial connector. The holding ring is made of a dielectric material and is elastically deformable. The deformation capability of the holding ring makes it possible for the coupling member to be displaced in an axial direction relative to the coaxial connectors and to be tilted from an axially aligned orientation so that, via the coupling member, positional inaccuracies and relative movements of the two circuit boards that are electrically interconnected by way of the connecting device can be compensated for. However, the elastically deformable holding ring counteracts micromovements of the coupling member which could lead to abrasion and therefore impairment of the electric transmission properties of the connecting device. While the motion capability of the coupling member for compensating positional inaccuracies and relative movements of the two circuit boards is practically not constrained by the elastically deformable holding ring, the latter counteracts, in particular, vibrations of the coupling member.

Advantageously, the holding ring is connected to the coupling member in form-locking engagement.

For example, provision may be made for the outer conductor of the coupling member to have, on its outer side, preferably centrally in longitudinal direction of the coupling member, an annular groove or an annular bead and for the holding ring to have a holding ring section that is formed complementary to the annular groove or the annular bead, said holding ring section extending into the annular groove in form-locking engagement therewith or surrounding the annular bead in form-locking engagement therewith.

The holding ring is made of a dielectric material. The holding ring is preferably made of an elastomer.

It is particularly advantageous for the holding ring to be profiled. The profiling gives the holding ring, in addition to its elasticity of material, an elasticity of shape which improves the deformation capability of the holding ring and therefore the movement capability of the coupling member for compensating positional inaccuracies and relative movements of the two circuit boards.

In a particularly preferred configuration of the invention, the holding ring is in splash-proof contact against the coupling member and at least one coaxial connector. The holding ring thus forms a sealing element which prevents the ingress of splashing water and debris, such as dust, into the area between the coupling member and the at least one coaxial connector.

Advantageously, the holding ring is in contact against the outer conductors of both coaxial connectors. In such a configuration, the coupling member supports itself, via the holding ring, against the two outer conductors of the coaxial connectors. The holding ring makes it possible for the coupling member to be centred using a design that is simple in structure. In addition, the holding ring facilitates positioning of the coupling member at the coaxial connectors and simplifies assembly of the connecting device.

The holding ring is preferably positioned between the outer conductors of the two coaxial connectors.

Provision may be made for the connecting device constructed in accordance with the invention to have a single elastically deformable dielectric holding ring via which the coupling member supports itself on one or both of the coaxial connectors.

In an advantageous improvement of the invention, the connecting device has at least two elastically deformable dielectric holding rings, wherein the coupling member supports itself, via a first holding ring, on the first coaxial connector and, via a second holding ring, on the second coaxial connector. Such a configuration is in particular advantageous where the coupling member is of relatively long configuration in order to span a relatively large distance between two circuit boards.

Advantageously, the at least one holding ring is connected to at least one outer conductor of the coaxial connectors in a force-locking manner and/or in a form-locking manner. By way of example, the holding ring may extend into an annular groove of an outer conductor and/or engage around a radially inwardly or radially outwardly directed extension of an outer conductor.

It is advantageous for the coupling member to have an insulation part which has the inner conductor of the coupling member extending therethrough and which is surrounded by an outer conductor of the coupling member and which limits tilting movement and axial movement of the coupling member relative to the coaxial connectors. On the one hand, the insulation part of the coupling member serves to provide electrical isolation between the coupling member's inner conductor and outer conductor. On the other hand, the insulation part of the coupling member forms a stop element with the help of which axial movements and tilting movements of the coupling member relative to the coaxial connectors can be limited.

For example, provision may be made for the insulation part to be capable of being brought into contact against the end face of an inner conductor of the coaxial connector once an end position of the coupling member has been reached. The insulation part thus forms a stop element which comes into contact against the end face of an inner conductor of the coaxial connector when the coupling member has reached an end position relative to that coaxial connector.

It is advantageous for the inner conductor of the coupling member to be of pin-shaped configuration and to be held in resilient end-face recesses of the inner conductors of the coaxial connectors.

Advantageously, the inner conductors of the coaxial connectors are of identical configuration and have in each case an end-face recess into which the inner conductor of the coupling member extends with an end region thereof.

Particularly good electric transmission properties, in particular very low intermodulation levels, are achieved in an advantageous configuration of the invention by the inner conductors of the coaxial connectors each having an end-face recess having a rotationally symmetric internal surface whose inner diameter varies over the entire length, or over at least part of the length, of the recess and has a minimum and by the inner conductor of the coupling member having end regions that face away from each other and have a cylindrical external surface, wherein the end regions each extend into a recess of an inner conductor of the coaxial connectors and contact the recess in an area of smallest inner diameter of the recess in a line contact. The combination of a cylindrical external surface and of a rotationally symmetric internal surface whose inner diameter varies, preferably continuously, over the length or at least part of the length of the recess and has a minimum makes it possible for the inner conductor of the coupling member to make practically line contact with the inner conductor of a coaxial connector. The coupling member can be tilted and axially displaced relative to the coaxial connectors for compensating positional inaccuracies and relative movements of the circuit boards. As the coupling member moves relative to one or both of the coaxial connectors, there will be no sudden change in geometry of the area of contact along which the inner conductor of the coupling member contacts the inner conductors of the coaxial connectors. This prevents the electric transmission properties of the connecting device from changing substantially when the coupling member moves. This counteracts the production of intermodulations in particular.

It is advantageous for the inner conductors of the coaxial connectors to be axially slotted and form radially inwardly inclined resilient tongues. When plugging an end region of an inner conductor of the coupling member into the recess of an inner conductor of a coaxial connector, the resilient tongues can be deformed radially outwardly, with the resilient tongues being in resilient contact against an end region of the inner conductor of the coupling member.

In a first longitudinal region of the resilient tongues, starting for example from the bottom of the recesses, the inner diameter of the recesses can decrease continuously and the first longitudinal region can be adjoined by a second longitudinal region of the resilient tongues in which the inner diameter of the recesses increases continuously. The pin-shaped inner conductor of the coupling member can, with a cylindrical end region thereof, extend into a recess, with the pin-shaped inner conductor being able to contact the recess in the area of smallest inner diameter thereof in a line contact.

In an advantageous embodiment of the invention, the outer conductors of the coaxial connectors each have an end-face recess with a cylindrical internal surface and the outer conductor of the coupling member has end sections that face away from each other and have a rotationally symmetric external surface whose outer diameter varies over the length, or part of the length, of the end section and has a maximum, with each end section extending into a recess of an outer conductor of a coaxial connector and contacting the recess in an area of largest outer diameter of the end section in a line contact. The combination of a rotationally symmetric external surface whose outer diameter varies, preferably continuously, over the length or at least part of the length of the external surface and has a maximum and of a cylindrical internal surface which contacts the external surface in the area of maximum diameter of the external surface makes it possible for the external surface to contact the internal surface in a line contact and, therefore, for the outer conductor of the coupling member to contact the outer conductors of the coaxial connectors in a line contact. The coupling member can be tilted and axially displaced relative to the coaxial connectors for compensating positional inaccuracies and relative movements of the circuit boards. As the coupling member moves relative to one or both of the coaxial connectors, there will be no sudden change in geometry of the area of contact along which the outer conductor of the coupling member contacts the outer conductors of the coaxial connectors. This prevents the electric transmission properties of the connecting device from changing substantially when the coupling member moves. This counteracts the production of intermodulations in particular.

It is advantageous for the end sections of the outer conductor of the coupling member to be axially slotted and form radially outwardly inclined resilient tongues. When the outer conductor of the coupling member is plugged into the recess of an outer conductor of a coaxial connector, the radially outwardly inclined resilient tongues can be deformed radially inwardly, with said resilient tongues being in resilient contact against the internal surface of the recess.

The following description of advantageous embodiments of the invention, taken in conjunction with the drawings, serves to explain the invention in greater detail.

DETAILED DESCRIPTION OF THE INVENTION

Figure 1:
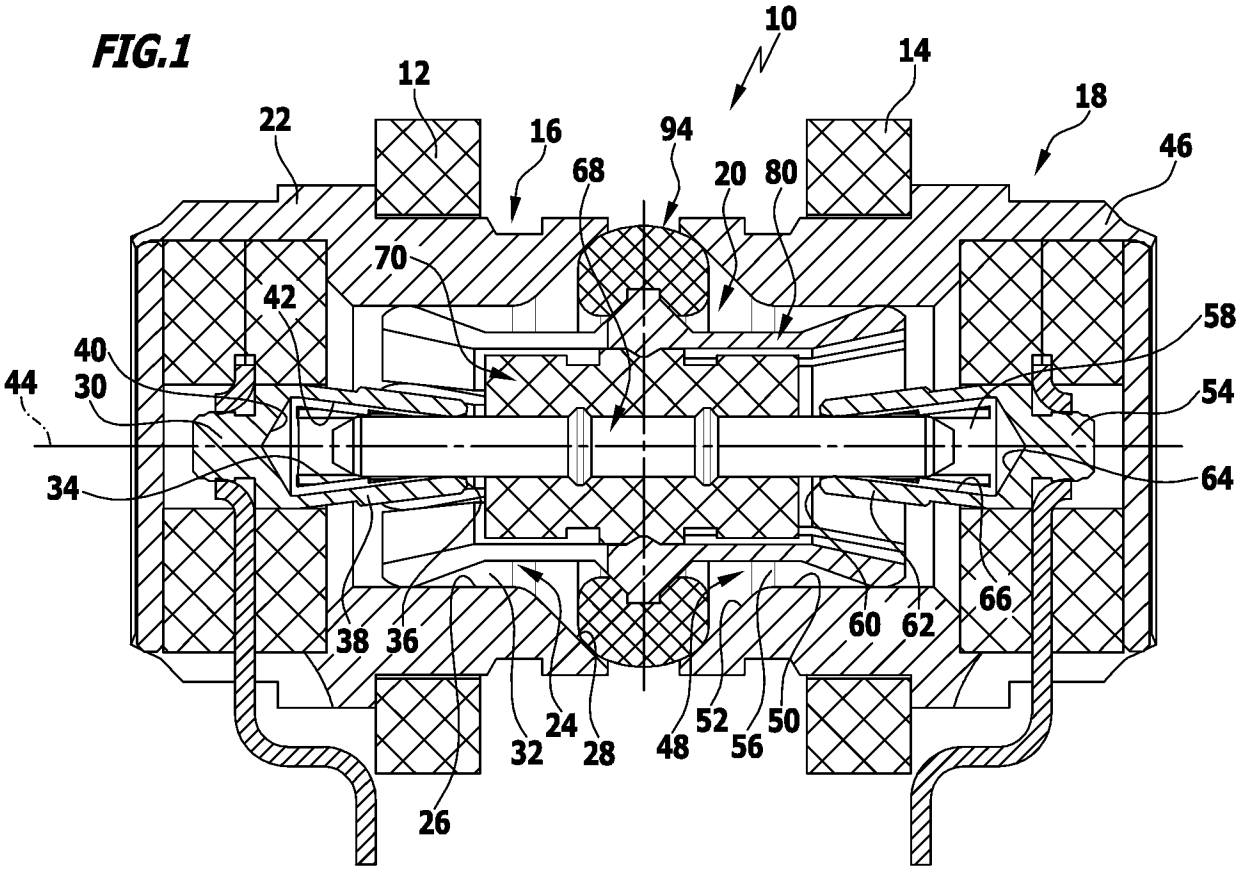
FIG. 1 is a sectional view of a first advantageous embodiment of a connecting device constructed in accordance with the invention, with a coupling member shown in an axially aligned orientation with respect to two coaxial connectors and axially centrally arranged between the two coaxial connectors.
Figure 2:
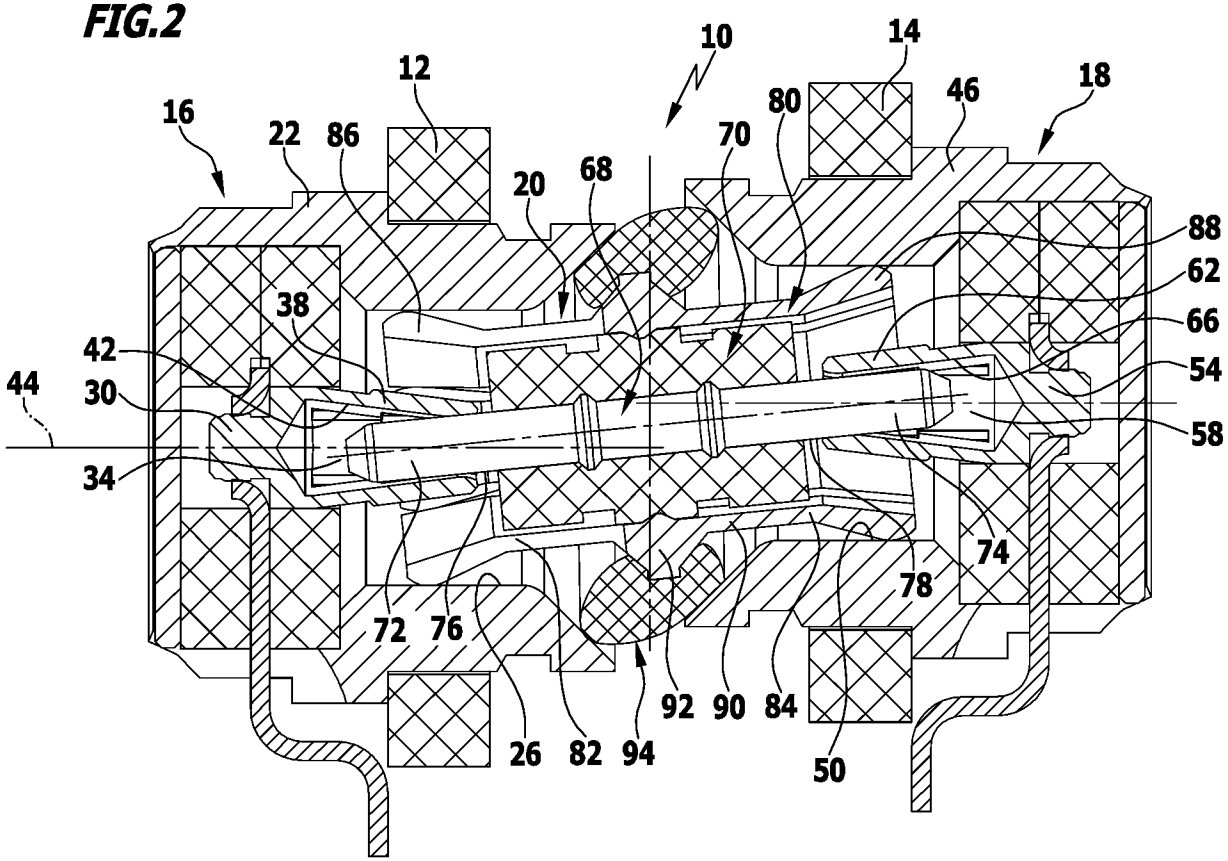
FIG. 2 is a sectional view of the connecting device from FIG. 1, with the coupling member shown tilted and axially displaced.

Schematically represented in FIGS. 1 and 2 is a first advantageous embodiment of a connecting device constructed in accordance with the invention, generally designated by the reference numeral 10. The connecting device 10 makes it possible for a first circuit board 12 to be electrically conductively connected to a second circuit board 14. To this end, the connecting device 10 has a first coaxial connector 16 and a second coaxial connector 18 and a coupling member 20 movably arranged between the two coaxial connectors 16, 18.

The first coaxial connector 16 is held on the first circuit board 12 and has a first outer conductor 22 which is configured in the manner of a socket and has a first recess 24 with a cylindrical middle section 26 and a conically diverging end section 28 which adjoins the cylindrical middle section 26 of the first recess 24 in a direction towards the second circuit board 14.

Arranged in the first recess 24 is a first inner conductor 30 of the first coaxial connector 16, with a first annular space 32 extending between the first inner conductor 30 and the wall of the cylindrical middle section 26 of the first recess 24.

The first inner conductor 30 has an end-face recess 34 and is axially slotted starting from its free end face 36 facing towards the second circuit board 14 so that it forms a plurality of resilient tongues 38 of identical configuration which are inclined radially inward starting from a bottom 40 of the recess 34. The inner surface 42 of the recess 34 is configured to be rotationally symmetric about a longitudinal axis 44, with its inner diameter first continuously decreasing with increasing distance from the bottom 40 and then continuously increasing in an end region adjacent to the free end face 36. At a small distance from the free end face 36, the inner diameter of the recess 34 is a minimum.

The second coaxial connector 18 is of identical configuration to that of the first coaxial connector 16. It has a second outer conductor 46 which is configured in the manner of a socket and has a second recess 48 with a cylindrical middle section 50 which is, in a direction towards the first circuit board 12, adjoined by a conically diverging end section 52.

The second outer conductor 46 surrounds a second inner conductor 54 of the second coaxial connector 18, with a second annular space 56 extending between the second inner conductor 54 and the cylindrical middle section 50 of the second outer conductor 46. The second inner conductor 54 has an end-face recess 58 and is axially slotted starting from its free end face 60 that faces towards the first circuit board 12. The second inner conductor 54 forms resilient tongues 62 of identical configuration which are inclined radially inward starting from the bottom 64 of the recess 58. The inner surface 66 of the recess 58 is configured to be rotationally symmetric, with its inner diameter first continuously decreasing with increasing distance from the bottom 64 and then continuously increasing in an end region adjacent to the free end face 60. At a small distance from the free end face 60, the inner diameter of the recess 58 is a minimum.

The coupling member 20 arranged between the two coaxial connectors 16, 18 has a pin-shaped inner conductor 68 which extends through an insulation part 70 in a longitudinal direction thereof and which, with a first end region 72 thereof, extends into the end-face recess 34 of the first inner conductor 30 and, with a second end region 74 thereof facing away from the first end region 72, extends into the end-face recess 58 of the second inner conductor 54. The two end regions 72, 74 each have cylindrical external surfaces 76 and 78 respectively which contact the rotationally symmetric internal surfaces 42 and 66 respectively of the recesses 34 and 58 respectively in the area of smallest inner diameter of the recesses 34, 58 in a line contact.

On its outer side, the insulation part 70 of the coupling member 20 carries an outer conductor 80 which, with a first end section 82 thereof, extends into the first recess 24 of the first outer conductor 22 and, with a second end section 84 thereof, extends into the second recess 48 of the second outer conductor 46. Both the first end section 82 and the second end section 84 are axially slotted and have a plurality of resilient tongues 86 and 88 respectively which are inclined radially outward starting from a middle section 90 of the outer conductor 80 that surrounds the insulation part 70 in a circumferential direction.

At a level of the cylindrical middle section 26 of the first recess 24, the outer conductor 80 has a rotationally symmetric external surface whose outer diameter varies continuously over the length of the first end section 82. Starting from the free end of the end section 82, the outer diameter first increases to then decrease continuously. At a small distance from the free end, the outer diameter of the end section 82 is a maximum. In the area of maximum outer diameter, the end section 82 contacts the cylindrical middle section 26 in a line contact.

Correspondingly, at a level of the cylindrical middle section 50 of the second outer conductor 46, the second end section 84 has a rotationally symmetric external surface whose outer diameter varies continuously over the length of the second end section 84. Starting from the free end of the end section 84, the outer diameter first increases to then decrease continuously. At a small distance from the free end, the outer diameter of the end section 84 is a maximum. In the area of maximum outer diameter, the end section 84 contacts the cylindrical middle section 50 in a line contact.

Centrally in the longitudinal direction, the outer conductor 80 is provided on its outer side with an annular bead 92 which is surrounded by an elastically deformable dielectric holding ring 94 in form-locking engagement therewith. The holding ring 94 is in splash-proof contact against the end section 28 of the first outer conductor 22 and the end section 52 of the second outer conductor 46, thereby forming a sealing element which seals the first annular space 32 and the second annular space 56 from splashing water and dust and other debris.

The holding ring 94 is made of an elastomer and elastically supports the coupling member 20 on the first outer conductor 22 and on the second outer conductor 46. The holding ring 94 centres the coupling member 20 between the two coaxial connectors 16 and 18 and counteracts micromovements of the coupling member 20, in particular vibrational motions of the coupling member 20.

The two circuit boards 12, 14 can be moved relative to each other in an axial direction with respect to the longitudinal axis 44 and transversely to the longitudinal axis 44. This results in axial movement and tilting movement of the coupling member 20 relative to the coaxial connectors 16, 18. FIG. 2 schematically shows the connecting device 10 after axial and radial movement of the two circuit boards 12, 14 relative to each other. It is apparent that the coupling member 20 assumes a tilted position, with the holding ring 94 undergoing elastic deformation. Once an end position is reached, the insulation part 70 of the coupling member 20 can contact the free end face 36 of the first inner conductor 30 or the free end face 60 of the second inner conductor 54, thereby preventing further relative movement of the coupling member relative to the coaxial connectors 16, 18. The insulation part 70 thus forms a stop element that limits the axial movement and the tilting movement of the coupling member 20.

It is also clear from FIG. 2 that even when the coupling member 20 is in a tilted position, the inner conductors 30 and 54 of the coaxial connectors 16, 18 contact the end regions 72 and 74 respectively of the inner conductor 68 of the coupling member 20 only in a line contact and, likewise, the cylindrical middle sections 26 and 50 of the outer conductors 22 and 46 respectively of the two coaxial connectors 16, 18 contact the end sections 82, 84 of the outer conductor 80 of the coupling member 20 only in a line contact. It is thereby ensured that even when the coupling member 20 is in a tilted and/or in an axially displaced position, the production of intermodulations can be kept low.

Figure 3:
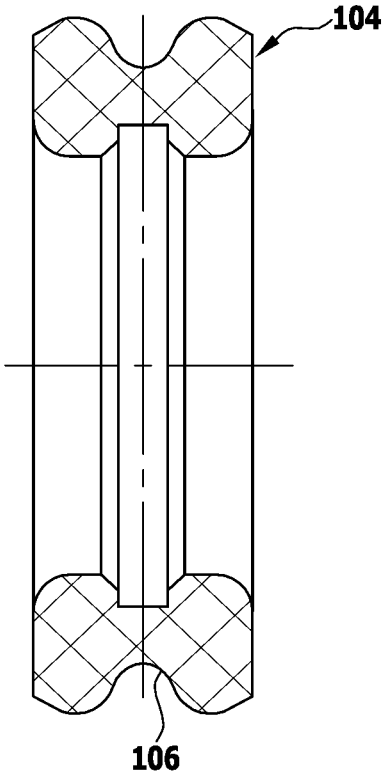
FIG. 3 is a sectional view of an alternative configuration of a holding ring of the connecting device from FIG. 1.

FIG. 3 schematically shows an alternative configuration of a holding ring 104 which may be used in the connecting device 10, instead of the holding ring 94. On its outer side, the holding ring 104 has an annular groove 106 which imparts an elasticity of shape to the holding ring 104. Therefore, the holding ring 104 can be deformed with a smaller amount of force than would be necessary for the holding ring 94 illustrated in FIGS. 1 and 2.

Figure 4:
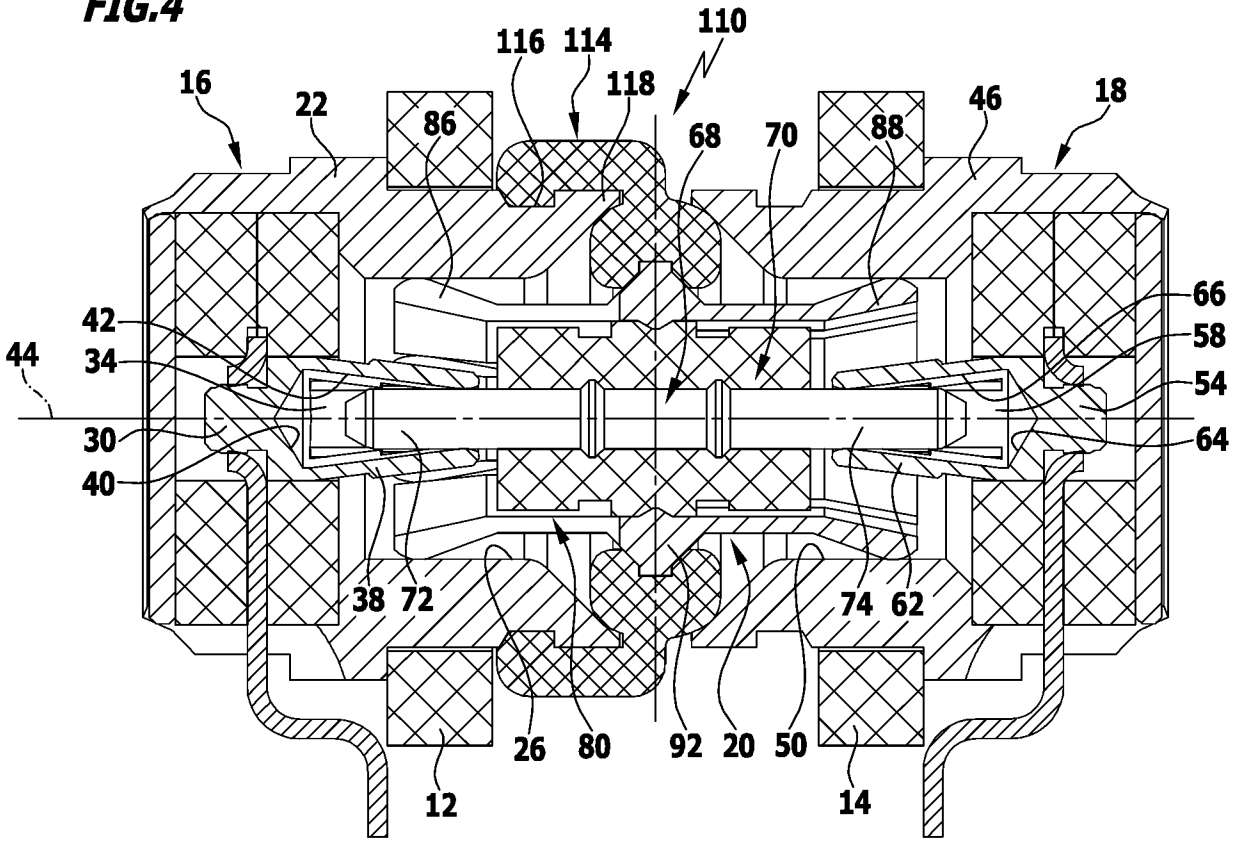
FIG. 4 is a sectional view of a second advantageous embodiment of a connecting device constructed in accordance with the invention, with a coupling member shown in axial alignment with two coaxial connectors and centrally arranged between the two coaxial connectors.

FIG. 4 illustrates a second advantageous embodiment of a connecting device constructed in accordance with the invention, represented generally by reference numeral 110. The connecting device 110 is largely identical to the connecting device 10 as described above with reference to FIGS. 1 and 2. Therefore, in FIG. 4, like components of FIGS. 1 and 2 are represented by like reference numbers and reference is made to the above explanation in relation to these components in order to avoid repetition.

The connecting device 110 differs from the connecting device 10 in that it uses, in lieu of the holding ring 94, a holding ring 114 which is connected in form-locking engagement not only with the annular bead 92 of the outer conductor 80 of the coupling member 20 but also with the outer conductor 22 of the first coaxial connector 16. To this end, the outer conductor 22 has a U-shaped annular groove 116 which surrounds the outer conductor 22 in a circumferential direction and the holding ring 114 forms form-locking engagement both with the annular groove 116 and the end region 118 of the first outer conductor 22 that adjoins the annular groove 116.

The holding ring 114, too, is in splash-proof contact against the end sections 28 and 52 of the two outer conductors 22 and 46 of the coaxial connectors 16, 18 and centres the coupling member 20 between the two coaxial connectors 16 and 18. Furthermore, the elastically deformable dielectric holding ring 114 also counteracts micromovements, in particular vibrations, of the coupling member 20.

In the same way as the coupling member 20 of the connecting device 10, the coupling member 20 of the connecting device 110 can be axially displaced relative to the coaxial connectors 16, 18 and can be tilted from the axially aligned orientation depicted in FIG. 4. What has been said above regarding the coupling member 20 of the connecting device 10 is true in the same way for the coupling member 20 of the connecting device 110, so that description will not be repeated here.

The connecting devices 10 and 110 are distinguished by providing high quality of transmission, while there is practically no risk of the coupling member 20 performing micromovements, in particular vibrations, which could cause abrasion and therefore impairment of the electric transmission properties.

What is claimed is:

1. Connecting device for electrically connecting two circuit boards, the connecting device comprising a first and a second coaxial connector and a coupling member, wherein the two coaxial connectors and the coupling member each have an outer conductor and an inner conductor and the outer conductors of the coaxial connectors are electrically interconnected via the outer conductor of the coupling member and the inner conductors of the coaxial connectors are electrically interconnected via the inner conductor of the coupling member and wherein the coupling member is arranged between the two coaxial connectors so as to be tiltable from an axially aligned orientation and displaceable in an axial direction, wherein the coupling member is held on an elastically deformable holding ring which surrounds the coupling member in a circumferential direction and is in contact against at least one coaxial connector.

2. Connecting device in accordance with claim 1, wherein the holding ring is connected to the coupling member in form-locking engagement.

3. Connecting device in accordance with claim 1, wherein the holding ring is made of an elastomer.

4. Connecting device in accordance with claim 1, wherein the holding ring is profiled.

5. Connecting device in accordance with claim 1, wherein the holding ring is in splash-proof contact against the coupling member and at least one coaxial connector.

6. Connecting device in accordance with claim 1, wherein the holding ring is in contact against the outer conductors of both coaxial connectors.

7. Connecting device in accordance with claim 1, wherein the holding ring is connected to at least one outer conductor of the coaxial connectors in one of a force-locking manner and a form-locking manner.

8. Connecting device in accordance with claim 1, wherein the coupling member has an insulation part which has the inner conductor of the coupling member extending therethrough and which is surrounded by the outer conductor of the coupling member and which limits tilting movement and axial movement of the coupling member relative to the coaxial connectors.

9. Connecting device in accordance with claim 8, wherein the insulation part is capable of being brought into contact against the end faces of the inner conductors of the coaxial connectors.

10. Connecting device in accordance with claim 1, wherein the inner conductor of the coupling member is of pin-shaped configuration and is held in resilient end-face recesses of the inner conductors of the coaxial connectors.

11. Connecting device in accordance with claim 1, wherein the inner conductors of the coaxial connectors each have an end-face recess having a rotationally symmetric internal surface whose inner diameter varies over the entire length, or over at least part of the length, of the recess and has a minimum and wherein the inner conductor of the coupling member has end regions that face away from each other and have a cylindrical external surface, wherein the end regions each extend into a recess of an inner conductor of the coaxial connectors and contact the recess in an area of smallest inner diameter of the recess in a line contact.

12. Connecting device in accordance with claim 1, wherein the inner conductors of the coaxial connectors are axially slotted and form radially inwardly inclined resilient tongues.

13. Connecting device in accordance with claim 1, wherein the outer conductors of the coaxial connectors each have an end-face recess with a cylindrical internal surface and wherein the outer conductor of the coupling member has end sections that face away from each other and have a rotationally symmetric external surface whose outer diameter varies over the entire length, or over at least part of the length, of the end section and has a maximum, with each end section extending into a recess of an outer conductor of a coaxial connector and contacting the recess in an area of largest outer diameter in a line contact.

14. Connecting device in accordance with claim 1, wherein the end sections of the outer conductor of the coupling member are axially slotted and form radially outwardly inclined resilient tongues.

* * * * *